US005584378A

United States Patent [19]

Wecke et al.

[11] Patent Number: 5,584,378

[45] Date of Patent: Dec. 17, 1996

[54] SAFETY SWITCH ASSEMBLY

[75] Inventors: Rolf Wecke, Bückeburg; Roland Mönnings, Porta Westfalica; Ralf Leggewie; Meinhard Gerner, both of Minden, all of Germany

[73] Assignee: Bernstein Classic GmbH & Co., Porta Westfalica, Germany

[21] Appl. No.: 380,022

[22] Filed: Jan. 30, 1995

[30] Foreign Application Priority Data

Feb. 2, 1994 [DE] Germany ..... 44 03 061.4

[51] Int. Cl.[6] ..... H01H 27/00

[52] U.S. Cl. ..... 200/43.04; 200/43.07; 200/43.11; 200/43.13; 200/43.16

[58] Field of Search ..... 200/43.04, 43.07, 200/43.09, 43.16, 43.13, 43.19, 43.21, 43.22, 318, 323, 324, 325, 326, 43.11, DIG. 70, 389

[56] References Cited

U.S. PATENT DOCUMENTS 4,454,392 6/1984 Rapp et al. ..... 200/43.07

4,524,251 6/1985 Schulz ..... 200/43.07

4,904,829 2/1990 Berthaud et al. ..... 200/43.04

*Primary Examiner*—David J. Walczak

*Attorney, Agent, or Firm*—Henry M. Feiereisen

[57] ABSTRACT

A safety switch assembly as part of a protective screen by which a motor-driven machine is enclosed includes a locking unit for allowing opening of the protective screen for access to the machine only after all moving motor parts are at a standstill, and a plunger which actuates an electric switch for cutting the electric supply to the machine. The plunger is linked to a control member which is moved by the plunger in response to a key insertable into a housing by which the safety switch assembly is fully enclosed. The locking unit includes a locking lever which is actuated by an electromagnetically actuatable locking mechanism to engage and immobilize the control member with the electric switch being actuated by the control member.

13 Claims, 4 Drawing Sheets

SAFETY SWITCH ASSEMBLY

BACKGROUND OF THE INVENTION

The present invention refers to a safety switch assembly, and in particular to a safety switch assembly of a type having a housing adapted for receiving a key by which a plunger is axially movable for operating an electric switch to interrupt a machine motor in dependence on the position of the plunger, and an electromagnetically actuated locking mechanism which allows a withdrawal of the key from the housing only after energizing the locking mechanism.

Operating regulations require the incoporation of such safety switch assemblies in protective screens which guard the interior of machines from the outside, if there exists a danger that these protective screens are opened during operation. In order to prevent this from occurring, safety switch assemblies are designed such that the protective screens are locked until the running parts of the machine come to a standstill and any danger of injury when coming into contact with these machine parts is eliminated. The protective screen can thus be opened only when removing the key from the housing by which the safety switch assembly is enclosed, with the plunger being guided for axial displacement in order to actuate the electric switch to cut the current supply to the machine motor.

In order to avoid unlocking of the protective screen in situations in which the machine still runs on after shutdown, a fact resulting also in a significant endangerment, the use of solenoid-operated locking units is known (European Patent No. EP 0 553 885, German Patent No. DE 38 10 287), by which the axial movement of the plunger is blocked until a control circuit querying the standstill of the machine signals a release. Only then disengages the locking unit and is the plunger movable so that the key can be withdrawn and the protective screen unlocked.

Conventional safety switch assemblies have the drawback that the arrangement of the locking unit is not freely selectable and thus the safety switch assembly cannot be best suited to changing conditions of the machine.

SUMMARY OF THE INVENTION

It is an object of the present invention to provide an improved safety switch assembly obviating the aforestated drawbacks.

In particular, it is an object of the present invention to provide an improved safety switch assembly which allows a random placement of the locking unit within the housing to best suit prevailing conditions.

These objects and others which will become apparent hereinafter are attained in accordance with the present invention by providing a control member which is movable by the plunger and immobilized by a locking lever operated by an electromagnetically actuatable locking mechanism, with the electric switch being switched by the control member.

In accordance with the present invention, the electric switch actuated by the control member can be arranged together with the locking mechanism in any position within the angular range of 360°. An important aspect of the present invention is the indirect actuation of the switching by the plunger via a deviation. Thus, the switch as well as the locking mechanism or a monitoring switch linked therewith can be arranged transversely to the direction of the plunger. In particular space-saving is the arrangement of the switch, the locking mechanism and the monitoring switch laterally to the plunger.

Operation of the locking mechanism is activated by a correspondingly designed control system of the machine. Upon activation of the locking mechanism, the locking lever simultaneously actuates the monitoring switch to cut the power supply to a circuit closer of the machine.

Under normal circumstances, with the protective screen enclosing the machine and the key being inserted in the housing so that the plunger is axially moved in direction of the key to rotate the control member for switching on the electric switch, the locking lever is pivoted by the spring force of the locking mechanism or by a spring bolt which separately acts upon the locking lever to engage and secure the control member in position. At the same time, as the locking lever pivots for engagement in the control member, the monitoring switch is actuated to release the circuit closer. In case of a malfunction, e.g. through fracture of the spring of the locking mechanism or of the spring bolt, the monitoring switch remains in the interrupt position as the locking lever is not actuated.

Suitably, the control member may be provided in form of a cam disk or a cam, with the locking lever having a hook which hooks behind a lug of the control member. Advantageously, the plunger is provided on the key-distant end with a bolt which engages an oblong hole of the control member to effect rotation thereof.

In accordance with one embodiment of the present invention, the locking mechanism is arranged in an area neighboring the hook while the monitoring switch is connected to the locking lever on the opposing end thereof. Alternatively, the position of the locking mechanism and the monitoring switch may also be reversed, with the monitoring switch being linked to the locking lever in the area of the hook.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
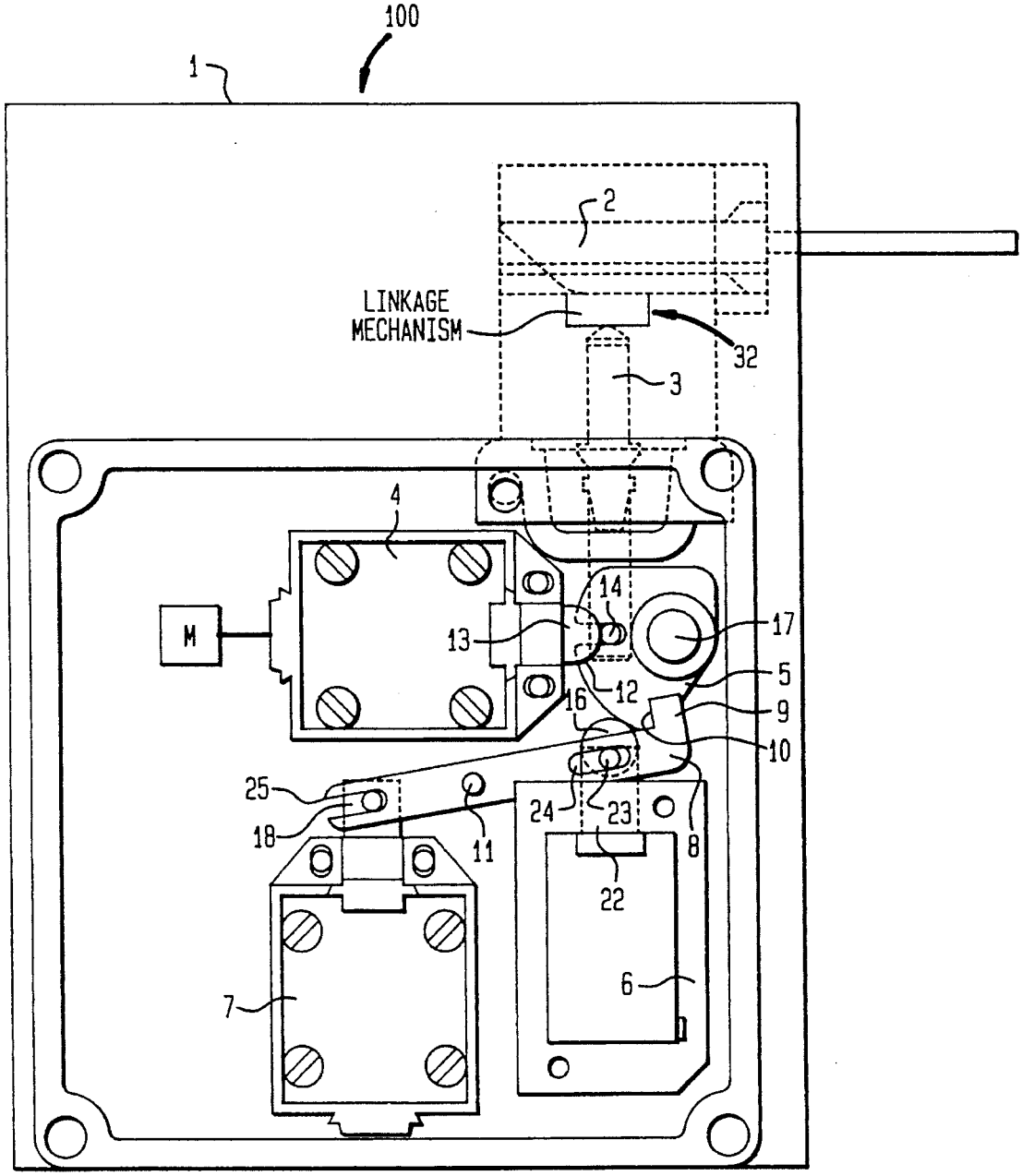
FIG. 1 is a schematic side view of one embodiment of a safety switch assembly according to the present invention in locking position.

Throughout all the Figures, the same or corresponding elements are generally indicated by the same reference numerals.

Turning now to the drawing, and in particular to FIG. 1, there is shown a schematic side view of one embodiment of a safety switch assembly according to the present invention, generally designated by reference numeral 100. The safety switch assembly is part of a protective screen (not shown) by which an external device such as a machine motor is surrounded to prevent access to moving motor parts during operation of the machine. The safety switch assembly 100 is enclosed by a housing 1 which is provided at a suitable location with a keyhole for insertion of a key 2 to initiate operation of the safety switch assembly and the motor.

Cooperating with the key 2 is a plunger 3 which is guided for axial displacement in response to the insertion of the key 2 in the keyhole of the housing 1 via a conventional linking mechanism, via a conventional linkage mechanism, generally designated by reference numeral 32 and interposed between the key 2 and the plunger 3. FIG. 1 shows the operational position in which the key 2 moves the plunger 3 axially upward to occupy the uppermost position. At the key-distant end thereof, the plunger 3 is provided with a radially protecting pin 14 which is guided in an oblong hole 15 of a control wheel in form of a cam disk 5 which is rotatably mounted on a shaft 17 in response to the up or down movement of the plunger 3.

Arranged transversely to the plunger 3 is an electric switch 4 for controlling the on and off operation of the machine motor M, as schematically indicated in FIG. 1. At the end facing the cam disk 5, the switch 4 has a switching element 13 which is received in a curved recess 12 of the cam disk 5 and moveable in axial direction during rotation of the cam disk 5 in response to the displacement of the plunger 3. Thus, depending on the position of the cam disk 5 and the position of the plunger 3, the motor of the machine is turned on or off.

The cam disk 5 is further provided with a lug 10 which is engageable by a hook 9 of a locking lever 8 swingably mounted in the housing for rotation about a pivot axis 11. Operation of the locking lever 8 is effected by an electromagnetically actuatable locking mechanism 6 which includes an actuating bolt 22 having one end provided with a pin 23 for engagement in an oblong hole 24 of the locking lever 8 in vicinity of the hook 9. The opposite end of the locking lever 8 is of forked configuration to define a slot 25 which receives and guides an actuating bolt 18 of a monitoring switch 7. The actuating bolts 18 and 22 move parallel however in opposite direction to each other.

In the embodiment of the safety switch assembly 100 shown in FIG. 1, the lift of the actuating bolt 22 of the locking mechanism 6 and thus the actuation of the locking lever 8 is executed in a same direction as the movement of the plunger 3.

In order to enable a disengagement of the locking lever 8 and the cam disk 5 in case of emergency, the locking mechanism 6 is further linked to a cam 16 which can be acted upon from outside only through application of a not commonly available special tool.

The operation of the safety switch assembly will now be described in more detail as applied to a protective screen surrounding the machine. In the position shown in FIG. 1, the key 2 is inserted in the keyhole of the housing 1 as the protective screen is closed and the motor M is in operation. The insertion of the key 2 causes the plunger 3 to move upwards to thereby rotate the cam disk 5 via the pin 14 inside the oblong hole 15. At the same time, the locking mechanism 6 causes the locking lever 8 via the actuating pin 22 to firmly engage with its hook 9 behind the lug 10 of the cam disk 5 so that the key 2 is secured to the housing 1 and is prevented from being extracted.

Figure 2:
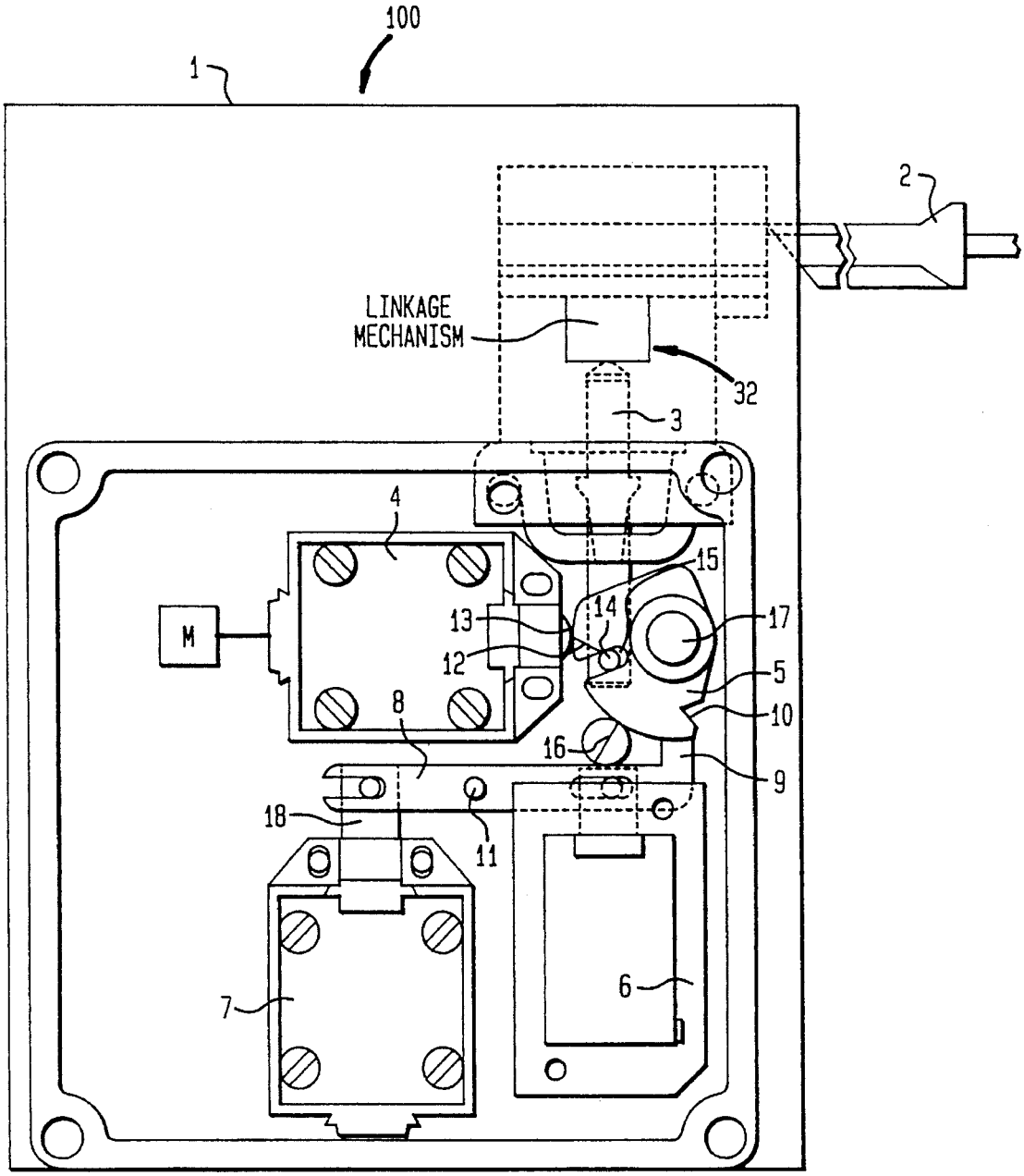
FIG. 2 is a schematic side view of the safety switch assembly of FIG. 1 in unlocked position.

When the protective screen is to be opened to allow access to the machine parts for inspection or maintenance, the electromagnetically actuatable locking mechanism 6 is energized to move the locking lever 8 via the actuating bolt 22 away from the cam disk 5 in direction of the locking mechanism 6. This disengages the hook 9 from the lug 10. The signal for energizing the locking mechanism 6 is sent by a suitable machine control system by which also the after running period of the moving machine parts is monitored. A disengagement of the locking lever 8 from the cam disk 5 frees the movement of the plunger 3 so that the key 2 can now be removed from the housing 1 and the protective screen can be opened. As the plunger 3 moves downwards in axial direction, the cam disk 5 is rotated counterclockwise and thereby actuates the switching element 13 which follows the contour of the recess 12 so that the electric switch 4 cuts the electric circuit to the machine motor M. This position is shown in FIG. 2. Thus, the machine cannot be switched on unintentionally when the protective screen is opened.

As further shown in FIG. 2, as the locking lever 8 is disengaged from the cam disk 5 by the attraction of the locking mechanism 6 through energizing the respective electromagnet, the actuating bolt 18 of the monitoring switch 7 is pulled to thereby cut a not shown circuit closer of the machine.

In case of a malfunction of the locking mechanism 6, for example through fracture of a spring, by which the locking lever 8 is normally moved into the locking position according to FIG. 1 after de-energizing the electromagnet, the locking lever 8 will remain in the position shown in FIG. 2 so that the actuating pin 18 of the monitoring switch 7 retains the extended position in which the circuit closer is cut. Operation of the machine without fixing the defect is not possible so that the safety aspect of the safety switch assembly according to the invention is further significantly improved.

Figure 3:
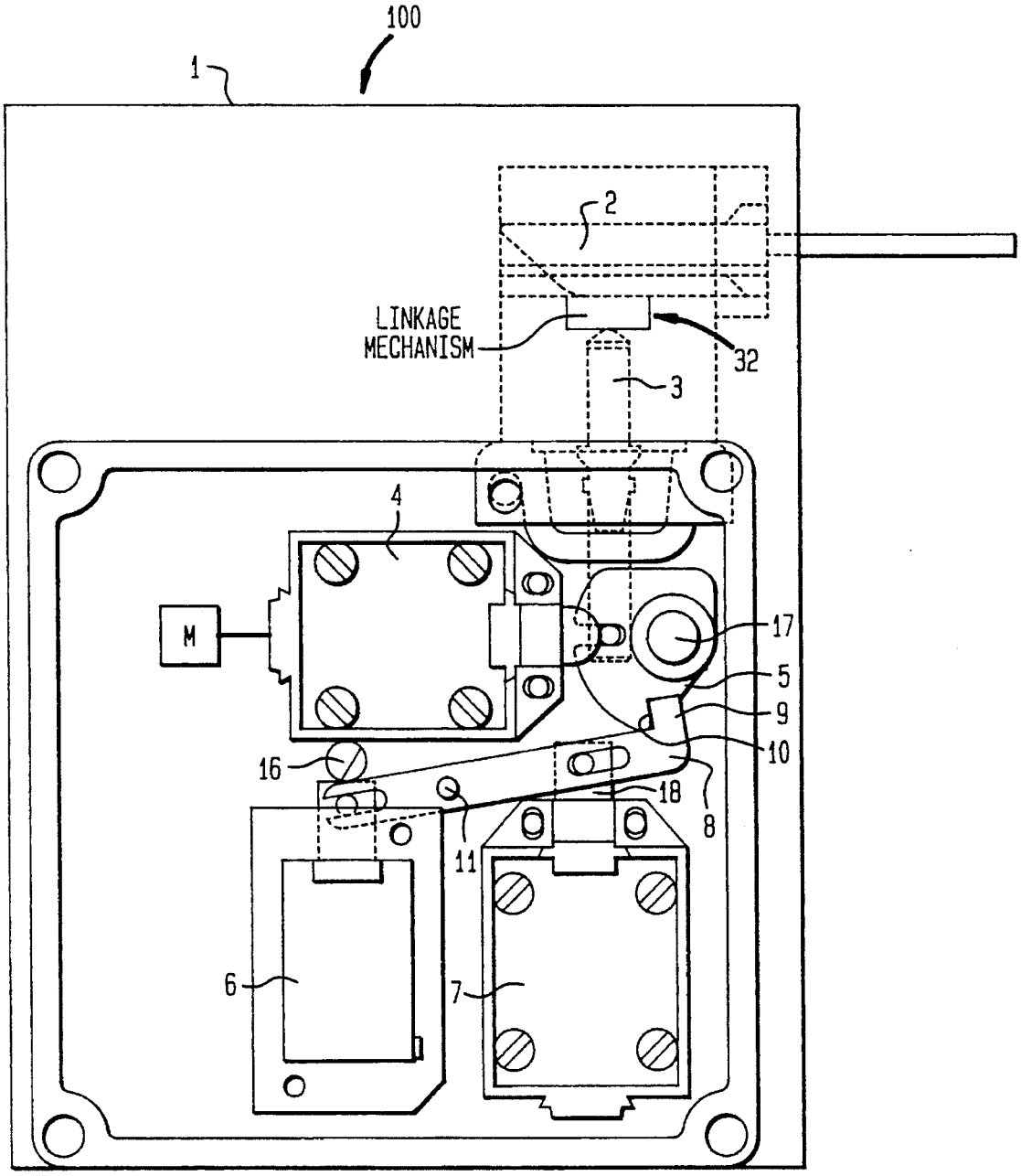
FIG. 3 is a schematic side view of a modified embodiment of a safety switch assembly according to the present invention in locking position.

In the non-limiting example shown in FIGS. 1 and 2, the coil of the electromagnet for the locking mechanism is magnetized by current flowing through the coil when the protective screen of the machine is opened. In contrast thereto, FIG. 3 shows a variation of a safety switch assembly in which the coil is demagnetized when the protective screen is open while being magnetized by current when the protective screen is closed. As shown in FIG. 3, the arrangement of the locking mechanism 6 and the monitoring switch 7 is now reversed, with the locking mechanism 6 being linked to the locking lever 8 at the end distant to the hook 9, and the monitoring switch 7 being secured to the opposite end neighboring the hook 9. This embodiment provides significant advantages when short work cycles require long opening periods of the protective screen because the coil of the electromagnet of the locking mechanism 6 will not excessively heat up through extended energizing of the electromagnet.

Figure 4:
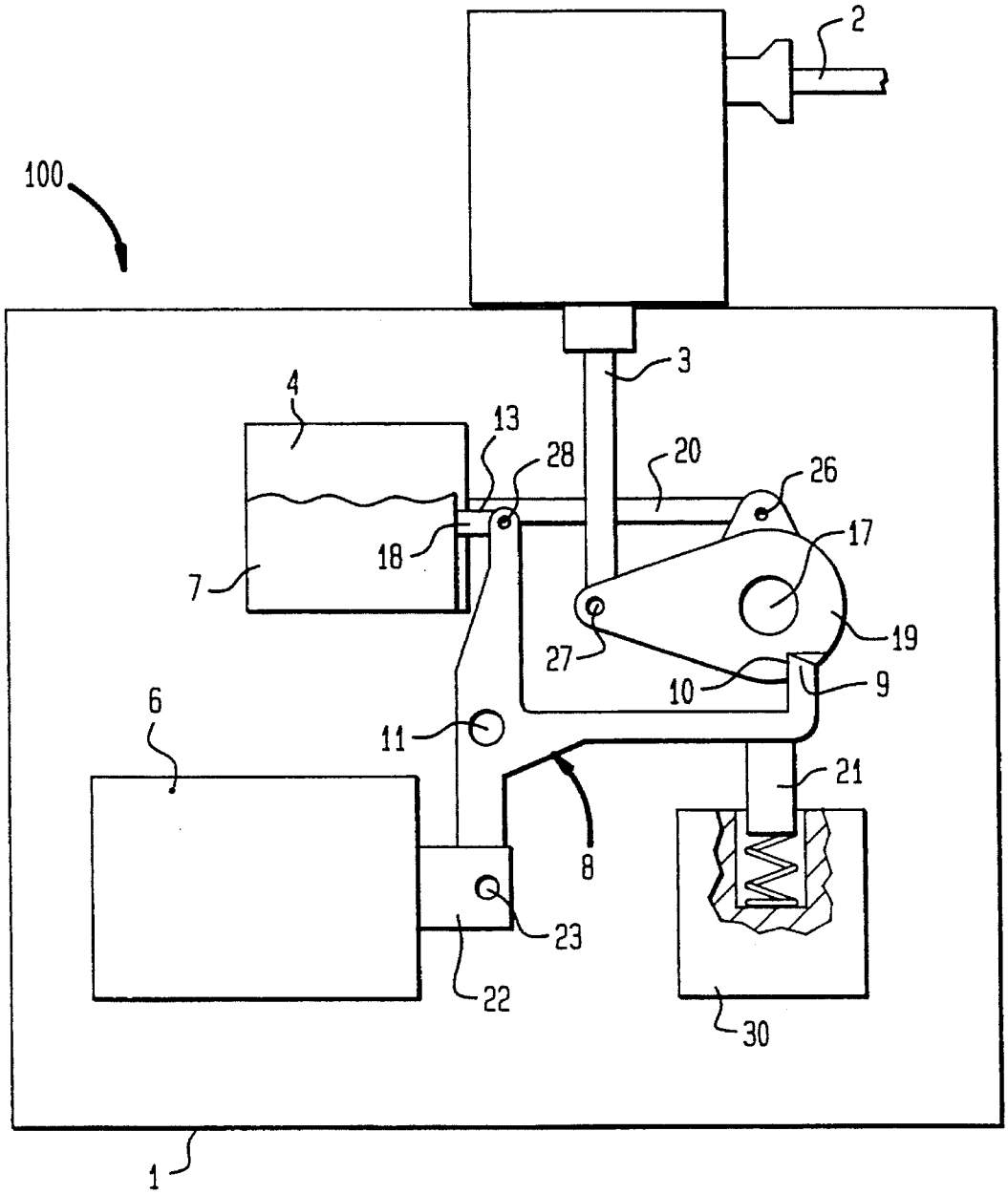
FIG. 4 is a simplified, schematic side view of another embodiment of a safety switch assembly according to the present invention in locking position.

The embodiments of the safety switch assembly 100 in FIGS. 1 and 3 depict only two examples of a placement of the electric switch 4 and/or the monitoring switch 7 and the locking unit 6, however, it is certainly possible to the provide different arrangements within the housing 1 to enable an optimum utilization of the available space. A further such arrangement is depicted in FIG. 4 in which the locking unit 6 as well as the monitoring switch 7 and the electric switch 4 are situated laterally to the plunger 3 so that the direction of movement of their actuating members 22, 18, 13 extends transversely to the movement of the plunger 3. The monitoring switch 7 is arranged upon the switch 4 to thereby attain a particularly space-saving construction. The control wheel is formed as a cam 19 which is rotatably mounted on a camshaft 17. Articulated to the cam 19 at 26 is a crank 20 which is connected to the switching element 13 of the switch 4 so that a rotation of the cam 19 in response to the movement of the plunger 3, which is articulated to the cam 19 at 27, actuates the switch 4. The deflection of the cam 19 during rotation is negligible with regard to the space demand.

As further shown in FIG. 4, the locking lever 8 is of substantially T-shaped configuration with the ends of the crossbar being articulated to the actuating pin 18 at 28 and to the actuating pin 22 of the locking mechanism 6 at 29, with the pivot axis 11 of the locking lever 8 situated between the points of articulation 28, 29 in prolongation of the leg carrying the hook 9 at its end.

In a same manner as described in connection with the embodiment of FIGS. 1 and 2, when the protective screen is to be opened to allow access to the machine, the locking mechanism 6 is energized to attract the actuating pin 22 and to disengage the locking lever 8 from the cam 19. At the same time, the actuating pin 18 of the monitoring switch 7 is pulled. The disengagement of the locking lever 8 from the cam 19 frees the plunger 3 which thus can be moved axially to operate the switching element 13 via the crank 20 as the key 2 is extracted.

In order to ensure a secure engagement of the locking lever 8 in the cam 19, a spring bolt 21 is provided which bears at one end against the cam-distant side of the locking lever 8 and sits with its other end in a respective cylinder 30. In this manner, the hook 9 of the locking lever 8 is urged into engagement behind the lug 10 of the cam 19 in order to securely retain the locking lever 8 in the cam 19. Provision of the spring bolt 21 permits the use of an electromagnetically actuatable locking mechanism which is not spring-loaded in energized or de-energized position. Thus, the use of a very simple magnetic switch is possible without incorporating a spring.

While the invention has been illustrated and described as embodied in a safety switch arrangement, it is not intended to be limited to the details shown since various modifications and structural changes may be made without departing in any way from the spirit of the present invention.

What is claimed as new and desired to be protected by Letters Patent is set forth in the appended claims:

We claim:

1. A safety switch assembly, comprising:

a housing adapted for receiving a key;

a plunger defining an axis and movable in an axial direction upon insertion of said key into said housing;

switching means operatively connected to a motor-driven machine for allowing cut-off of a power supply to the machine;

a rotatable control member interposed between said plunger and said switching means for switching on and off said switching means in response to a position of said plunger; and a locking mechanism for preventing said key from extraction from said housing during operation of the motor-driven machine, said locking mechanism including a locking lever which is engageable in said control member for immobilizing said control member.

2. The switch assembly of claim 1 wherein said control member is a cam disk.

3. The switch assembly of claim 1 wherein said control member is a camshaft.

4. The switch assembly of claim 1 wherein said locking mechanism is connected to said locking lever at one end thereof, and further comprising a monitoring switch including a circuit closer for operation of the machine, said monitoring switch being connected to said locking lever on the other end thereof, with the locking lever being swingably mounted about a pivot axis arranged between said monitoring switch and said locking mechanism.

5. The switch assembly of claim 1 wherein an element from the group consisting of said switching means, said monitoring switch and said locking mechanism is arranged in a direction transversely to said axis of said plunger.

6. The switch assembly of claim 4 wherein said monitoring switch and said switching means are connected to each other in superimposed relationship.

7. The switch assembly of claim 1 wherein said control member has a lug and said locking lever has a hook engageable behind said lug of said control member in locking position.

8. The switch assembly of claim 7 wherein said locking mechanism is connected to said locking lever in an area neighboring said hook.

9. The switch assembly of claim 7 wherein said locking mechanism is connected to said lever in an end area distant to said hook

10. The switch assembly of claim 1 wherein said control member has an oblong hole, said plunger having a pin on an end distant to said key for engagement in the oblong hole of said control member.

11. The switch assembly of claim 1 wherein said control member has a curved recess, said switching means including a switching element received in said recess.

12. The switch assembly of claim 1, further comprising a crank connecting said switching means with said control member.

13. The switch assembly of claim 1, further comprising a spring bolt for urging said locking lever in direction of said control member.

* * * * *